US007909111B1

(12) United States Patent
Hinojosa et al.

(10) Patent No.: US 7,909,111 B1
(45) Date of Patent: Mar. 22, 2011

(54) OUTDOOR FIRE PREVENTION SYSTEM AND ASSOCIATED METHOD

(76) Inventors: Andres Hinojosa, La Quinta, CA (US); Chris Martinez, La Quinta, CA (US)

( * ) Notice: Subject to any disclaimer, the term of this patent is extended or adjusted under 35 U.S.C. 154(b) by 406 days.

(21) Appl. No.: 12/221,641

(22) Filed: Aug. 5, 2008

Related U.S. Application Data

(60) Provisional application No. 60/963,386, filed on Aug. 6, 2007.

(51) Int. Cl.
*A62C 35/00* (2006.01)

(52) U.S. Cl. ..... 169/16; 169/5; 169/45; 169/56; 169/19; 239/69; 700/284; 340/506

(58) Field of Classification Search ..... 169/16, 169/5, 45, 56, 46, 7, 8, 19, 13; 239/69, 71; 340/506; 700/284
See application file for complete search history.

(56) References Cited

U.S. PATENT DOCUMENTS 1,389,527 A * 8/1921 Oates ..... 169/5
1,620,142 A * 3/1927 Thompson ..... 239/208
2,865,674 A * 12/1958 Jelmeland ..... 239/208
RE26,121 E * 12/1966 Wiegand ..... 169/5
5,165,482 A * 11/1992 Smagac et al. ..... 169/45
5,692,571 A * 12/1997 Jackson ..... 169/16
5,732,511 A * 3/1998 Scott ..... 52/1
5,864,287 A * 1/1999 Evans et al. ..... 340/506
5,931,233 A * 8/1999 La Bonte et al. ..... 169/5
6,195,002 B1 * 2/2001 Evans et al. ..... 340/506
6,450,264 B1 * 9/2002 Christian ..... 169/16
6,629,569 B1 * 10/2003 Adams ..... 169/56
6,732,951 B1 5/2004 Salazar
6,772,562 B1 * 8/2004 Dadamo ..... 52/1
6,824,073 B1 * 11/2004 Haney ..... 239/208
6,929,072 B2 * 8/2005 Brown ..... 169/46
6,964,379 B2 * 11/2005 Crowley ..... 239/208
2005/0192710 A1 * 9/2005 Thornton et al. ..... 700/284
2006/0060362 A1 * 3/2006 Crowley ..... 169/46
2007/0114046 A1 * 5/2007 Munroe ..... 169/16
2007/0158083 A1 * 7/2007 Duncan ..... 169/16
2007/0221388 A1 * 9/2007 Johnson ..... 169/16
2009/0090520 A1 * 4/2009 Lee ..... 169/16

* cited by examiner

*Primary Examiner* — Len Tran
*Assistant Examiner* — Trevor E McGraw

(57) ABSTRACT

An outdoor fire prevention system preferably includes an existing roof structure with a plurality of first and second groups of water discharging assemblies. The system may also include a mechanism for automatically distributing water to a target group of water discharging assemblies by selecting assemblies from each of the first and second groups when sensors, located in the roof, indicate that the roof surface temperature, of a target region of is elevated above a maximum threshold temperature. The outdoor fire prevention system may further include a controller that is connected to a primary water shutoff valve in fluid communication with the automatic water distributing mechanism which automatically controls the amount of water transmitted to the system. The outdoor fire prevention system may also include a primary conduit in fluid communication with the primary water shutoff valve and traveling downstream therefrom, directing water where needed.

6 Claims, 7 Drawing Sheets

OUTDOOR FIRE PREVENTION SYSTEM AND ASSOCIATED METHOD

CROSS REFERENCE TO RELATED APPLICATIONS

This application claims the benefit of U.S. Provisional Application No. 60/963,386, filed Aug. 6, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to fire prevention systems and, more particularly, to an outdoor fire prevention system for reducing a likelihood of fire damage while preserving water consumption.

2. Prior Art

The spread of wild fires to residential areas is a constant threat in many locations, particularly during dry seasons. Often such wild fires will cause damage to many homes and buildings which are burned either from direct contact with flames or from embers spewed from the fire that fall on the roofs of homes and buildings, sometimes from a long distance from the fire. Thus, such fires threaten destruction to large areas crowded with residential homes and other buildings. When a wild fire threatens a certain area, firefighters have little option but to directly fight the fire itself or take the necessary actions to address the threat of the fire spreading. A lack of manpower and adequate resources in many instances results in devastation of homes and buildings without any type of fire prevention or fire suppression equipment.

A variety of water systems for controlling wildfires that frequently approach a dwelling or a building have been employed in the past. Such systems disclose basic removable and manually operated sprinkler systems often supplied by garden hoses and meant to be placed on the roof when fires are approaching. These roof top systems can be a good tool for fighting off small fires until fire fighters can arrive to assist the home owner. They also may assist in stopping the fire from spreading to neighboring buildings. Unfortunately, known removable roof top sprinkler systems are difficult to successfully place on the roof in order to reach all areas of the house and take considerable time to install on a roof when fires may be rapidly approaching. Further, known sprinkler systems may unnecessarily dispense water to areas of the roof that are not in danger, thereby needlessly using water supplies.

U.S. Pat. No. 6,629,569 to Adams discloses a pop up roof sprinkler system attached to the roof of a building and including a fire retardant solution, a dispensing tube that has a distal portion extending outwardly from the roof, and a cap member. The cap member has a head portion and an insertion portion that are movable between an open position and a closed position. The open position is defined by the head portion being spaced from the dispensing tube to permit dispensation of the fire retardant solution through the dispensing tube. Unfortunately, this prior art example does not provide a system that controls the discharge of water to only those sections of the roof that need it, thereby preserving water consumption.

U.S. Pat. No. 6,732,951 to Salazar discloses a roof mounted evaporative cooling system utilizing a plurality of elongate deflectors that are supported and secured a short distance above the ridge of a gable roof by a plurality of support bracket connectors. The support bracket connectors are joined together by a plurality of sections of flexible tubing having opposed ends engaged on a hose barb of the connectors and secured by hose clamps. Water is supplied to the connectors by conduit connected through a battery operated timer to an outdoor water faucet or to the cold water supply pipe in the attic of the building. In operation, the fine mist of water is under standard domestic water pressure and spreads evenly along the underside of the deflectors and runs onto the roof. Unfortunately, this prior art example is operated by a timer and does not provide a plurality of heat-detecting sensors positioned along the roof structure to activate the water discharging mechanism when the roof temperature reaches a certain level due to fire.

U.S. Pat. No. 6,824,073 to Haney discloses a portable fire protection system that has a plurality of sprinkler assemblies connected together in series. Each sprinkler assembly has a water manifold pipe, a pair of U-shaped supports, and a sprinkler head pivotally connected to the water manifold pipe. During use, the support legs of the front and rear U-shaped supports are supported by front and rear roof sections of a house with the apex of the roof extending between the pair of U-shaped supports. The intended purpose of the design is to replace the use of a common garden sprinkler being placed on the roof to ward off fire. Unfortunately, this prior art example does not provide an automatic activation of a water discharging mechanism and instead requires a user to set up and manually activate the water when fire damage is impending.

U.S. Pat. No. 6,929,072 to Brown discloses a device and method for inhibiting the spread of a fire to the roof of a building by placing a base supporting a sprinkler on the roof. A hose connected to the base and in fluid communication with the sprinkler provides a source of water ejected from the sprinkler onto the roof. The interior of the base may be wetted to increase its weight. A rope, normally stored on a spool removably attached to the base, may be used to reposition the base on the roof. Unfortunately, this system also requires the user to quickly set up the water discharging mechanism when fire damage is impending by attempting to position the device in the proper location to reach every area of the roof in danger.

Accordingly, a need remains for an outdoor fire prevention system in order to overcome the above-noted shortcomings. The present invention satisfies such a need by providing a system that is convenient and easy to use, is durable in design, is versatile in its applications, and provides users with a custom designed fire prevention system for their dwelling. Not just for home owners, the present invention is also invaluable for commercial establishments as well, allowing businesses to better protect their interests and assets. The system effectively eliminates the spread of wildfires while also preserving water consumption. Additionally, the system tempers the increasing costs of fire insurance, another important advantage that makes this system well received by the general consumer populace as well as most business establishments.

BRIEF SUMMARY OF THE INVENTION

In view of the foregoing background, it is therefore an object of the present invention to provide a system for reducing a likelihood of fire damage while preserving water consumption. These and other objects, features, and advantages of the invention are provided by an outdoor fire prevention system.

An outdoor fire prevention system for reducing the likelihood of fire damage while preserving water consumption preferably includes a roof structure attached to a building and a plurality of first groups of water discharging assemblies situated on the existing roof structure. The outdoor fire prevention system may also include a plurality of second groups of water discharging assemblies situated on the existing roof structure. This allows the system to reach the entire surface of the roof so as no part of the structure is left vulnerable to wildfires.

Additionally, a mechanism may be included for automatically distributing water to a target group of water discharging assemblies. Such a mechanism may advantageously select the assemblies from each of the first and second groups of water discharging assemblies when a roof surface temperature of a target region of the roof structure is elevated above a maximum threshold roof surface temperature, such that remaining ones of the water discharging assemblies remain at off positions, thereby reducing water consumption. This system works to focus the dispensing of water to high-risk areas susceptible to fire damage so as to quickly disperse the threat. A user is thereby able to focus his attention on the safety of the occupants in the building and important personal items rather than trying to individually suppress an approaching wildfire.

The outdoor fire prevention system may further include a primary water shutoff valve in fluid communication with the automatic water distributing mechanism. Such a primary water shutoff valve is preferably adapted to receive and selectively transmit an external water supply to the automatic water distributing mechanism. The valve automatically controls the amount of water transmitted to extinguish the fire so that the user is free to focus on other safety precautions. The outdoor fire prevention system may also include a primary conduit in fluid communication with the primary water shutoff valve and traveling downstream therefrom, directing water to where it is needed on the roof structure. Such primary conduit further is preferably in fluid communication with the automatic water distributing mechanism and is located downstream thereof.

The outdoor fire prevention system may further include a controller communicatively coupled to the primary water shutoff valve. Such controller preferably generates and transmits a user input signal based upon a user input to remotely interrupt the external water supply prior to reaching the first and second groups of water discharging assemblies. In this manner, water may be automatically directed into the system by electronic adjustment of the valve requiring no manual activation by the user. The controller is an important feature because it distinguishes the current invention from the prior art by allowing a user to either stay safely in the home or leave the site altogether and not worry about whether the house will be severely damaged without having to manually direct water to the approaching danger.

The pluralities of first and second groups of water discharging assemblies may be further located subjacent to each other, allowing water to easily flow to all assemblies and cover the entire surface of the roof. Such first and second groups of water discharging assemblies may further include first and second water discharging nozzles positioned at oppositely facing lateral edges of the roof structure. Additionally, a plurality of first auxiliary conduits is preferably in fluid communication with the primary conduit as well as the first and second water discharging nozzles respectively.

The first and second groups of water discharging assemblies may also include a plurality of valves housed within a corresponding one of the first auxiliary conduits respectively. Each of such valves may be located downstream from an associated one of the first and second water discharging nozzles respectively. Furthermore, one of the valves is preferably a main valve situated upstream of remaining ones of the valves which is effective such that water is permitted to flow to the first and second water discharging nozzles while water is restricted from flowing to an adjacent group of the first groups of water discharging assemblies that is located downstream of the main valve. The system of valves allows the water distributing mechanism to automatically discharge water to the areas directed by the temperature sensors as being in danger while preventing water from soaking areas where no threat of imminent fir exists.

The second groups of water discharging assemblies may further include first, second, and third water discharging nozzles positioned adjacent to an apex of the roof structure thereby dispensing water from the highest point of the roof down upon the structure and more adequately covering the entire area. Such a second group of water discharging assemblies may also advantageously include a plurality of second auxiliary conduits in fluid communication with the first auxiliary conduits as well as the first, second and third water discharging nozzles respectively. In addition, a plurality of valves is housed within a corresponding one of the second auxiliary conduits respectively. Each of such valves is located downstream from an associated one of the first, second, and third water discharging nozzles.

The water distributing mechanism may further include a plurality of heat-detecting sensors preferably positioned along the roof structure. Each of such heat-detecting sensors may generate and transmit an information signal bearing a real-time roof surface temperature of the roof region associated therewith as well as the location of the roof region. These heat-detecting sensors allow the system to detect which part of the structure is in most danger and dispense water accordingly. For example, if wind-blown embers lands on a certain portion of the roof, the heat-detecting sensors will activate the system to extinguish the embers to prevent a fire from igniting and causing property damage.

The water distributing mechanism may also include a processor communicatively coupled to the heat-detecting sensors and a memory electrically coupled to the processor. Such a memory preferably includes programmable software instructions that effectively cause water to selectively reach the target group of the first and second pluralities of water discharging assemblies and extinguish the danger. Additionally, the memory may include programmable software instructions that include and execute a control logic algorithm.

The control logic algorithm may include the first step of requesting a user to enter the maximum threshold roof surface temperature via the controller. This prevents the system from activating at times when surface temperatures of the roof may vary but fire damage is not imminent. A second step of the control logic algorithm preferably includes verifying receipt of the maximum threshold roof surface temperature. The next step of the control logic algorithm may include requesting each of the heat-detecting sensors to transmit the information signal associated therewith. A fourth step of the control logic algorithm may further include extrapolating the real-time roof surface temperature and the roof region location from the information signals respectively.

In the fifth step, the control logic algorithm preferably determines whether any one of the real-time roof surface temperatures is elevated above the maximum threshold roof surface temperature and thereby requires attention. If step five is yes, the control logic algorithm preferably validates the location of the roof region associated with the elevated real-time roof surface temperature and generates and transmits an output control signal to the target group of water discharging assemblies such that water is permitted to flow outwardly therefrom and thereby effectively lowers the elevated real-time roof surface temperature to a level below the maximum threshold roof surface temperature. These objects of the invention better assist the building occupants to preserve their property and remain at a safe distance from oncoming fires rather than staying in a dangerous situation.

It is also an object of the present invention to provide a method for reducing the likelihood of fire damage while preserving water consumption. As wildfires are often a result of dry temperatures, water resources may be scarce and the water that is used to extinguish fires should be employed in the most efficient manner possible. The current method may include the chronological step of first selecting a roof structure attached to a building. A second step of the method may then include providing and situating a plurality of first groups of water discharging assemblies at the existing roof structure. Thirdly, the method's steps may include providing and situating a plurality of second groups of water discharging assemblies at the existing roof structure. The next step of the method preferably includes providing and adapting a primary water shutoff valve to receive and selectively transmit an external water supply to the first and second groups of water discharging assemblies respectively.

The fifth step of the method may further include providing and fluidly communicating a primary conduit with the primary water shutoff valve such that the primary conduit travels downstream therefrom, the primary conduit further being in fluid communication with the first and second groups of water discharging assemblies and located downstream thereof respectively.

The sixth step of the method preferably includes providing and communicatively coupling a controller to the primary water shutoff valve to automatically operate the system without the user's constant attention. The seventh step of the method may include automatically distributing water to a target group of water discharging assemblies selected from each of the first and second groups of water discharging assemblies when a roof surface temperature of a target region of the roof structure is elevated above a maximum threshold roof surface temperature such that remaining ones of the water discharging assemblies remain at off positions and thereby reduce water consumption.

The final step of the method may include the controller generating and transmitting a user input signal based upon a user input to remotely interrupt the external water supply prior to reaching the first and second groups of water discharging assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
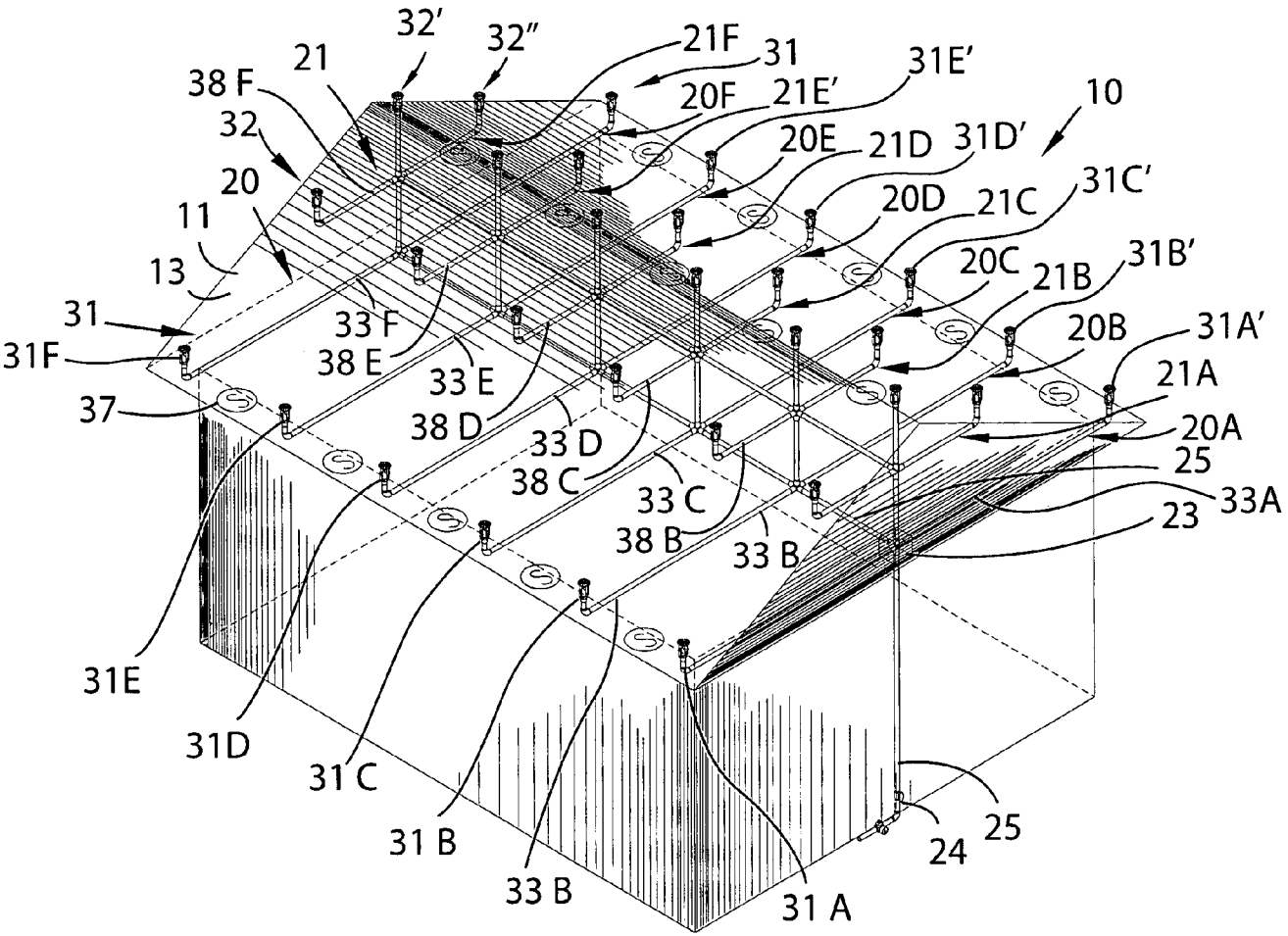
FIG. 1 is a perspective view showing an outdoor fire prevention system, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIG. 17 by the reference numeral 10 and is intended to provide an outdoor fire prevention system. It should be understood that the system 10 may be used to reduce the likelihood of fire damage to many different types of structures and should not be limited in use to the applications mentioned herein. For example, the system may be installed on a variety of structures including residential, commercial, and the like.

Figure 2:
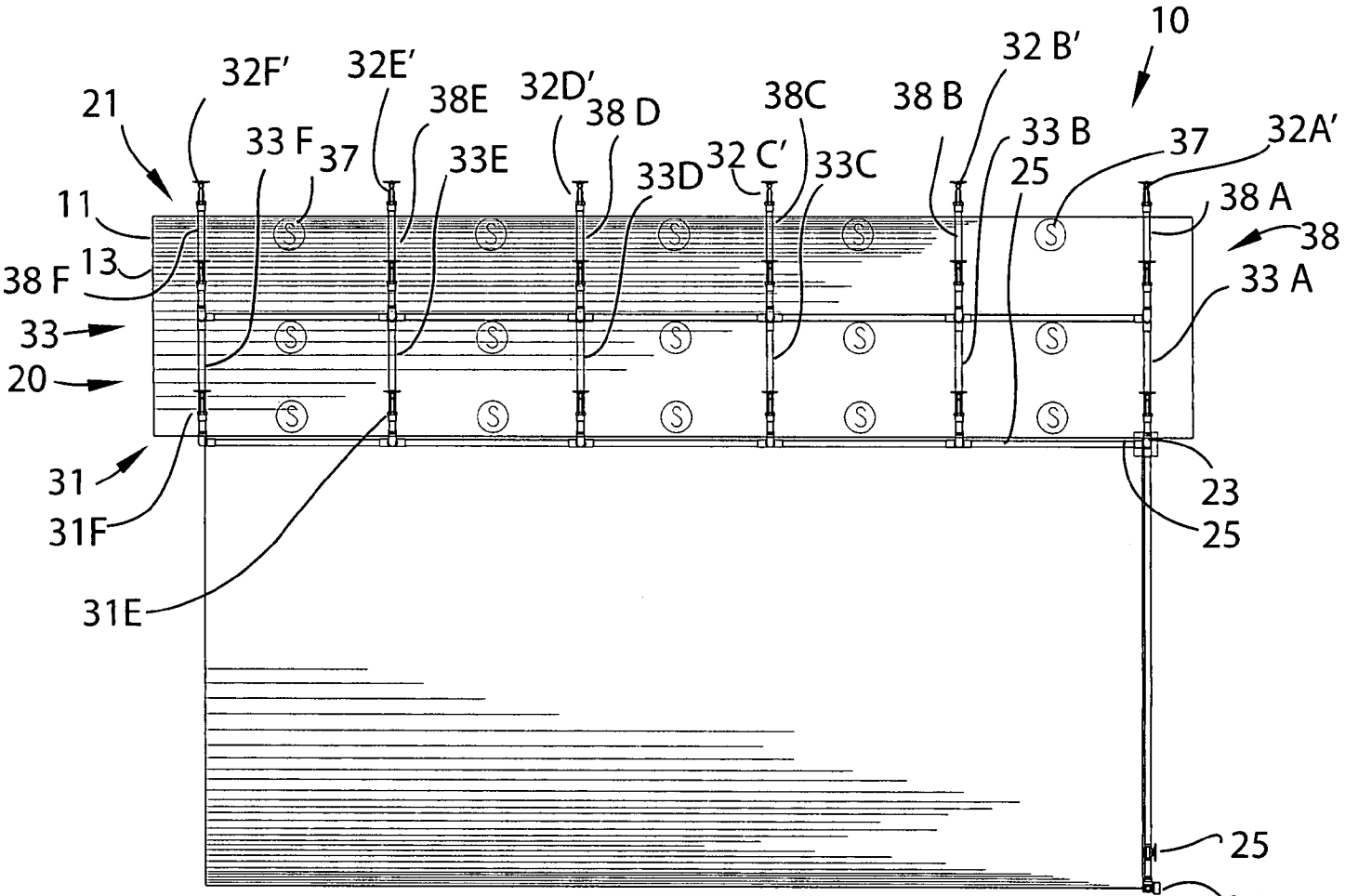
FIG. 2 is a side elevational view showing the outdoor fire prevention system of FIG. 1 with the sensors positioned along the roof structure.
Figure 3:
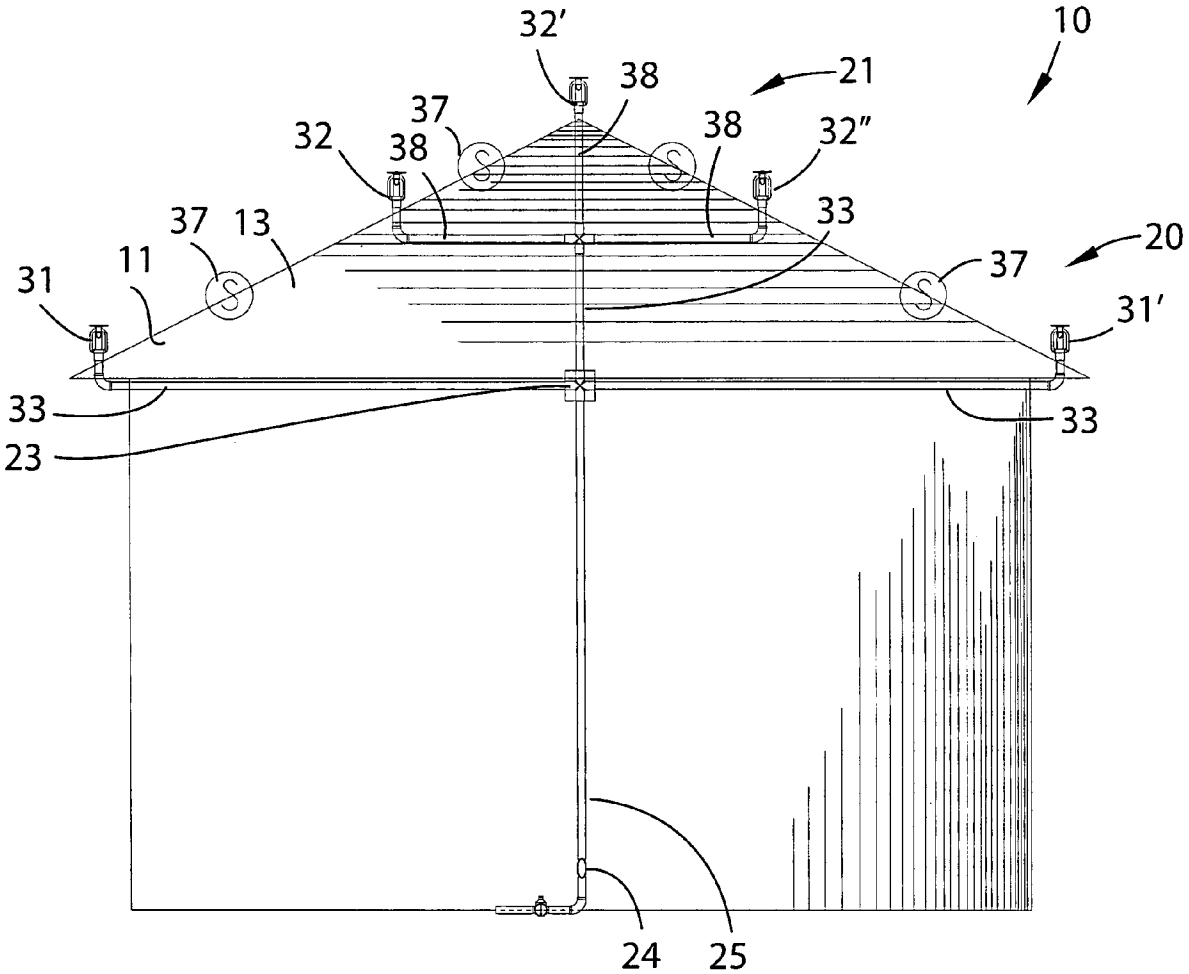
FIG. 3 is a front elevational view showing an outdoor fire prevention system shown in FIG. 1.
Figure 4:
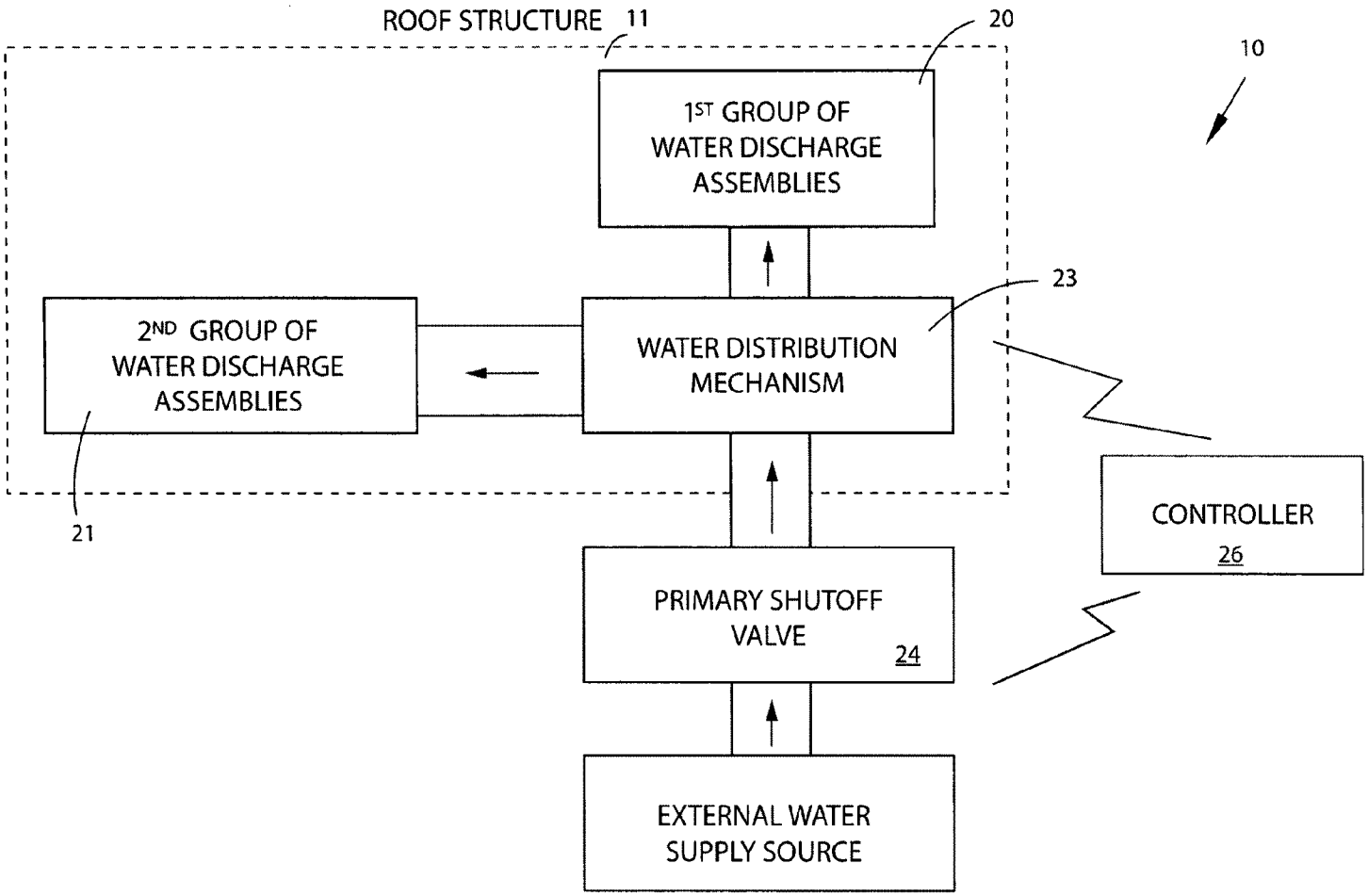
FIG. 4 is a high-level schematic block diagram showing communicative interrelationship between the major components of the present invention.
Figure 5:
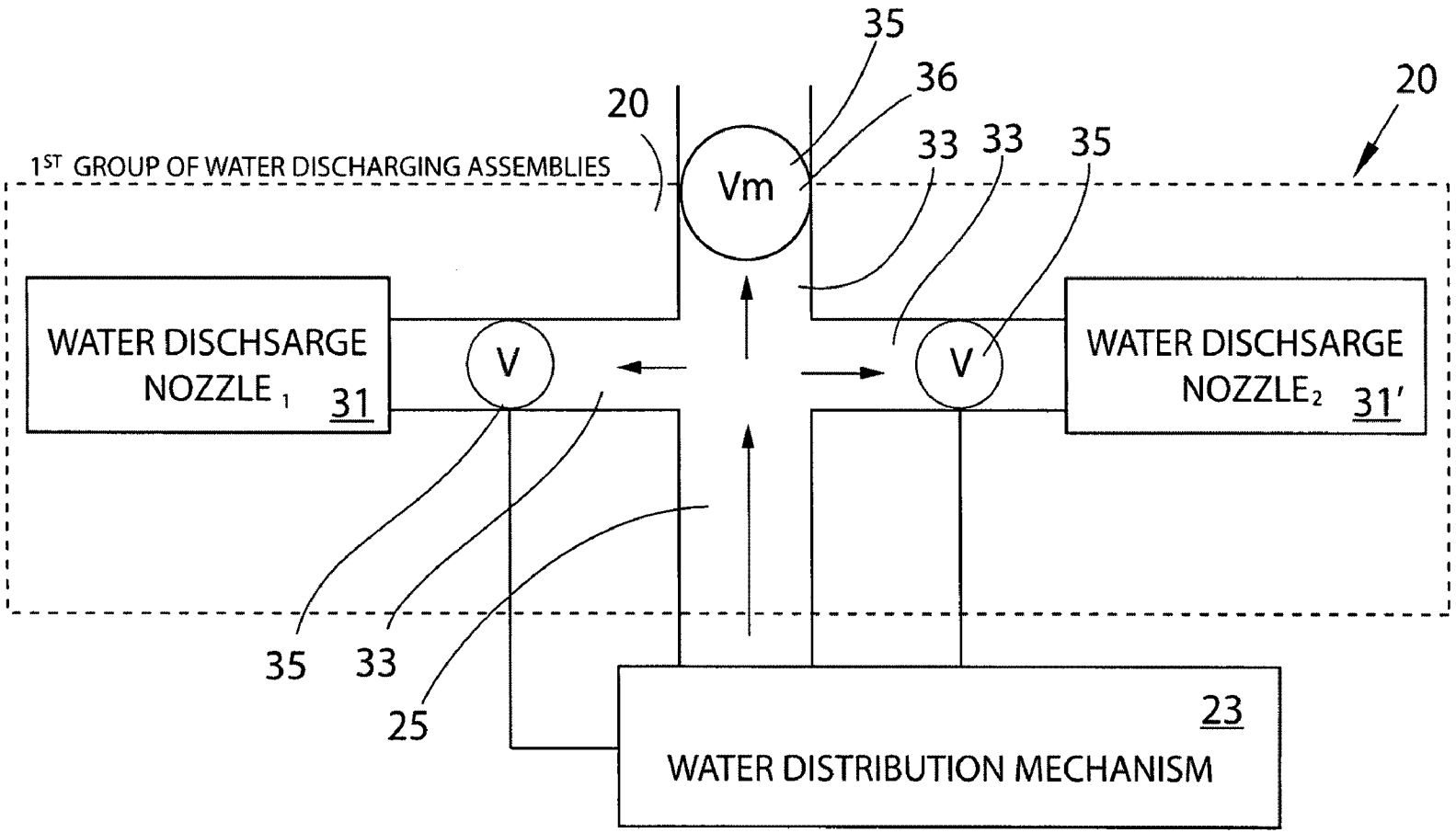
FIG. 5 is a schematic block diagram showing a water discharging assembly of the first group.
Figure 6:
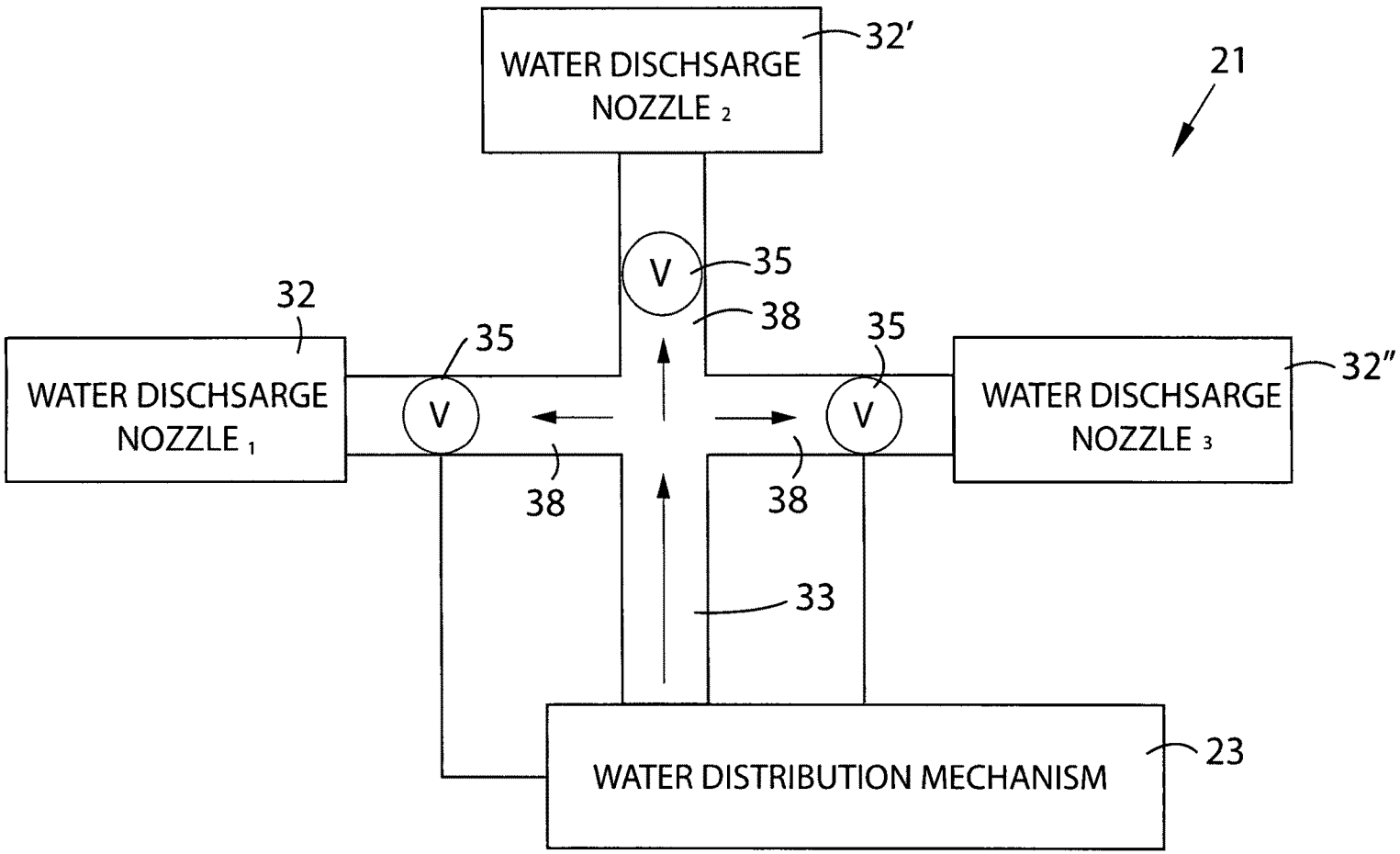
FIG. 6 is a schematic block diagram showing a water discharging assembly of the second group.

Referring initially to FIGS. 1-3, the outdoor fire prevention system 10 for reducing the likelihood of fire damage while preserving water consumption preferably includes a roof structure 11 attached to a building 12 and a plurality of first groups of water discharging assemblies 20 situated on the existing roof structure 11. The outdoor fire prevention system 10 may also include a plurality of second groups of water discharging assemblies 21 situated on the existing roof structure 11. This allows the system 10 to reach the entire surface 13 of the roof so as no part of the structure 11 is left vulnerable to wildfires.

Additionally, a mechanism 22 may be included for automatically distributing water to a target group of water discharging assemblies. Such a mechanism 22 may advantageously select the assemblies from each of the first and second groups of water discharging assemblies 20, 21 when a roof surface temperature of a target region of the roof structure 11 is elevated above a maximum threshold roof surface temperature, such that remaining ones of the water discharging assemblies 20, 21 remain at off positions, thereby reducing water consumption.

The combination of the automatic water distributing mechanism 23 with pluralities of groups of water discharging assemblies 20, 21 solves the problem of having to manually activate a fire prevention system. This system 10 focuses the dispensing of water to the areas being at risk to fire damage so as to quickly prevent the threat. A user is thereby able to focus his attention on the safety of the occupants in the building and important personal items rather than trying to individually suppress an approaching wildfire.

Referring to FIGS. 1-4, the outdoor fire prevention system 10 may further include a primary water shutoff valve 24 in fluid communication with the automatic water distributing mechanism 23. Such a primary water shutoff 24 valve is preferably adapted to receive and selectively transmit an external water supply to the automatic water distributing mechanism 23. The primary water shutoff valve 24 automatically controls the amount of water transmitted to the pluralities of groups of discharging assemblies 20, 21 in order to cover the roof surface with water so that the user is free to focus on other safety precautions.

The outdoor fire prevention system 10 may also include a primary conduit 25 in fluid communication with the primary water shutoff valve 24 and traveling downstream therefrom. Such primary conduit 25 further is preferably in fluid communication with the automatic water distributing mechanism and is located downstream thereof. The primary water shutoff valve 24 solves the problem associated with earlier prior art examples where the user is required to manually set up and activate a fire prevention system precedent to a fire approaching the structure.

In overcoming the prior art shortcomings, this present system 10 is permanently installed in the roof structure and activates and deactivates automatically with the primary water shutoff valve 24. Referring to FIGS. 4-7, the outdoor fire prevention system 10 may further include a controller 26 communicatively coupled to the primary water shutoff valve 24. Such a controller 26 preferably generates and transmits a user input signal 27 based upon a user input 28 to remotely interrupt the external water supply prior to reaching the first and second groups of water discharging assemblies 20, 21. In this manner, water may be automatically directed into the system 10 by electronic adjustment of the primary water shutoff valve 24 requiring no manual activation by the user. The controller 26 is an extremely important feature in that it distinguishes the present invention from the prior art by allowing a user to either stay safely in the home or leave the site altogether and not worry about whether the house will be severely damaged without the user constantly having to manually direct water to the approaching danger.

Referring to the FIGS. 1-3, 5 and 6, the pluralities of first groups of water discharging assemblies 20 may be further located subjacent to the second groups of water discharging assemblies 21, allowing water to easily flow to all assemblies and cover the entire surface 13 of the roof. It should be noted that although the plurality of first groups of water discharging assemblies is referred to by numeral 20, each individual group of the first group of water discharging assemblies may also be referred to collectively by numeral 20. Additionally, each first group of water discharging assemblies may be referred to collectively with respective numerals 20A, 20B, 20C, 20D, 20E, 20F.

Likewise, it should be noted that although the plurality of second groups of water discharging assemblies is referred to using the numeral 21, each individual second group of water discharging assemblies may also be referred to using the numeral 21. Each of the second group of water discharging assemblies may further be referred to by respective numerals 21A, 21B, 21C, 21D, 21E, 21F.

In one embodiment, the first groups of water discharging assemblies 20 may include first 31 and second 31' water discharging nozzles positioned at oppositely facing lateral edges of the roof structure 11. It should be noted that the first 31 and second 31' water discharging nozzles may also be referred to by the numerals 31A, 31,B, 31C, 31D, 31E, 31F and 31A', 31B', 31C', 31D', 31E', 31F' respective to a corresponding group of the first group of water discharging assemblies 20 to which the nozzles are attached.

The second groups of water discharging assemblies 21 may also include first 32, second 32', and third 32" water discharging nozzles (explained in further detail below). It should noted that the first 32, second 32', and third 32'" water discharging nozzles may also be referred to by the numerals 32A, 32B, 32C, 32D, 32E, 32F, 32A', 32B', 32C', 32D', 32E', 32F', and 32A", 32B", 32C", 32D", 32E", 32F", respective to a corresponding group of the second group of water discharging assemblies 21 to which the nozzles are attached.

Additionally, a plurality of first auxiliary conduits 33 is preferably in fluid communication with a primary conduit 25 as well as the first 31 and second 31' water discharging nozzles respectively. It should be noted that each of such first auxiliary conduits 33 may also be referred to using reference numerals 33A-33F respective to a corresponding group of the first group of water discharging assemblies 20 to which the conduits 33 are attached.

The claimed element of the multiple groups of water discharging assembles (explained hereinabove) and conduits creates a modular design, which provides an unexpected benefit of allowing a user to adapt the system with roof structures of varying design and dimension.

Referring to FIGS. 1-3, and 5, the first 20 and second 21 groups of water discharging assemblies may also include a plurality of valves 35 housed within a corresponding one of the first auxiliary conduits 33 respectively. It should be noted that each of such valves 35 may also be referred to by reference numerals 35A-35F, respective to a corresponding first 20 or second 21 group of water discharging assemblies where the valves 35 are located. The valves 35 may also be located downstream from an associated one of the first 31 and second 31' water discharging nozzles respectively Furthermore, one of the valves 35 is preferably a main valve 36 situated upstream of remaining ones of the valves 35 which is effective such that water is permitted to flow to the first 31 and second 31' water discharging nozzles while water is restricted from flowing to an adjacent group of the first 20 groups of water discharging assemblies that is located downstream of the main valve 36.

It should be noted that each main valve 36 may also be referred to using the reference numerals 36A-36E, respective to the corresponding first 20 or second 21 groups of water discharging assemblies in which the main valve 36 is located. These claimed elements are vital so that water may be directed only where needed. For instance, if water is needed only in the section of the roof containing one of the first groups of water discharging assemblies 20A, water may be directed to that first group of water discharging assemblies 20A as well as the corresponding first 31A and second 31'A discharging nozzles but water will not be directed to another one of the first groups of water discharging assemblies 20B. The system of valves 35 preserves water by allowing the water distributing mechanism 23 to automatically discharge water to the areas directed by the temperature sensors 37 which are in danger while preventing water from discharging to areas where no protection is needed.

Referring to FIGS. 1-3, and 6, the second 21 groups of water discharging assemblies may further include the first 32, the second 32', and the third 32" water discharging nozzles positioned adjacent to an apex of the roof structure 11 thereby dispensing water from the highest point of the roof down upon the structure and more adequately covering the entire area if needed. The second 21 group of water discharging assemblies may also include a plurality of second auxiliary conduits 38 in fluid communication with the first auxiliary conduits 33 as well as the first 32, second, 32' and third 32" water discharging nozzles respectively.

It should be noted that each of such second auxiliary conduits 38 may also be referred to using reference numerals 38A-38F respective to a corresponding group of the second group of water discharging assemblies 21 in which the conduits 38 are located. In addition, a plurality of valves 35 may also be housed within a corresponding one of the second auxiliary conduits 38 respectively. Each of such valves 35 is preferably located downstream from an associated one of the first 32, second 32', and third 32" water discharging nozzles. It should be noted that each of the valves 35 may also be referred to using the reference numerals 35A-35F, respective to the corresponding second 21 groups of water discharging assemblies where which the valves 35 are located.

Referring to FIGS. 1-3, and 7, the water distributing mechanism 23 may further include a plurality of heat-detecting sensors 37 preferably positioned along the roof structure 11. Each of such heat-detecting sensors 37 may generate and transmit an information signal bearing a real-time roof surface temperature of the roof region associated therewith as well as the location of the roof region. The heat-detecting sensors 37 allow the system 10 to detect which part of the structure is in most danger and dispense water accordingly. For example, if wind-blown embers lands on a certain portion of the roof, the heat-detecting sensors will activate the system to extinguish the embers and prevent a fire from igniting and causing property damage.

Figure 7:
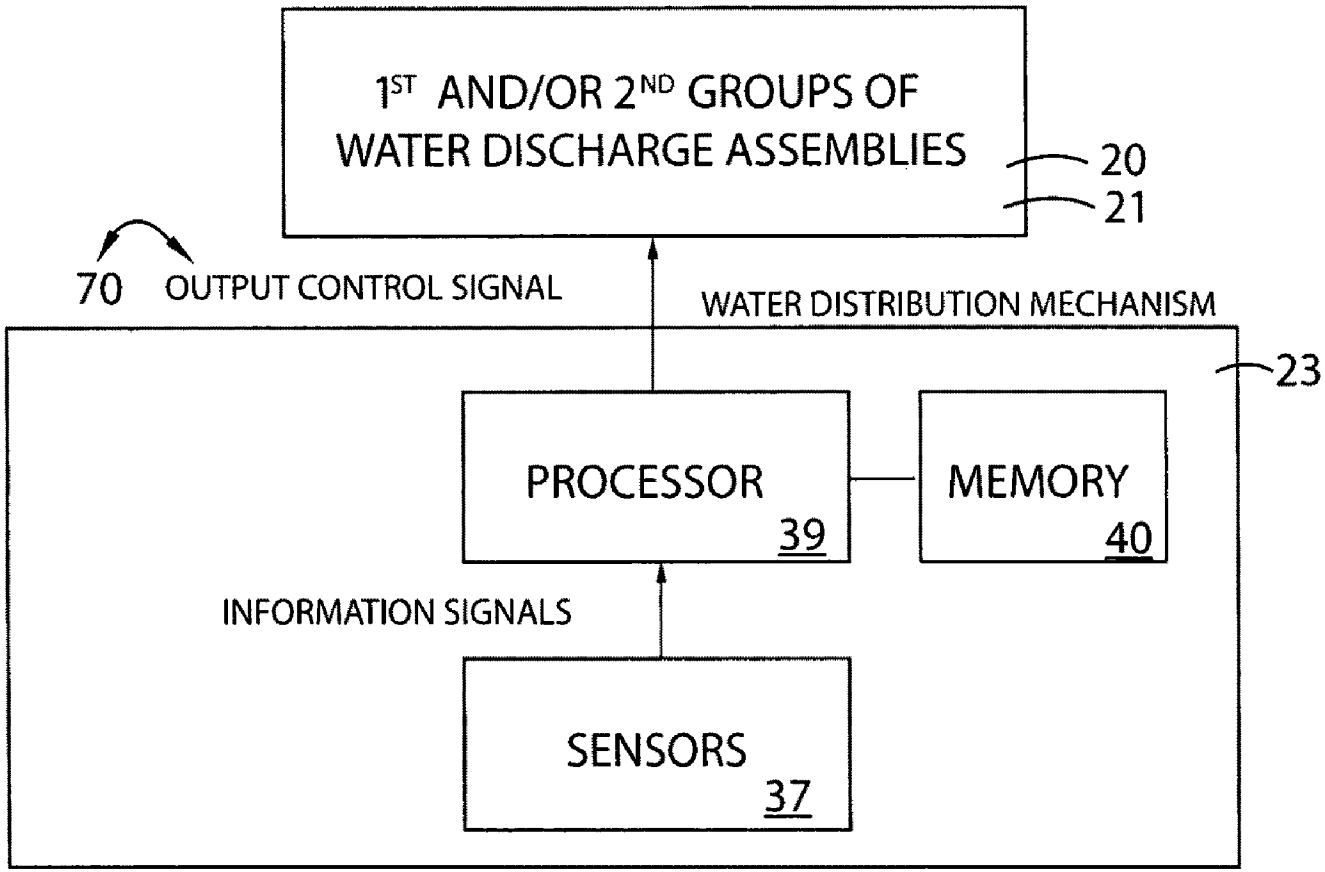
FIG. 7 is a schematic block diagram showing the interrelationship between the components of the water distribution mechanism, in accordance with the present invention.

Referring to FIG. 7, the water distributing mechanism 23 may also include a processor 39 communicatively coupled to the heat-detecting sensors 37 and a memory 40 electrically coupled to the processor 39. Such a memory 40 preferably includes programmable software instructions that effectively cause water to selectively reach the target group of the first 20 and second 21 pluralities of water discharging assemblies and extinguish the danger. Additionally, the memory 40 may include programmable software instructions that include and execute a control logic algorithm.

The control logic algorithm may include the first step of requesting a user to enter the maximum threshold roof surface temperature via the controller 26. This prevents the system from activating at times when surface temperatures of the roof may vary but fire damage is not imminent. A second step of the control logic algorithm preferably includes verifying receipt of the maximum threshold roof surface temperature. The third step of the control logic algorithm may include requesting each of the heat-detecting sensors to transmit the information signal associated therewith.

A fourth step of the control logic algorithm may further include extrapolating the real-time roof surface temperature and the roof region location from the information signals respectively. In the fifth step, the control logic algorithm preferably determines whether any one of the real-time roof surface temperatures is elevated above the maximum threshold roof surface temperature and thereby requires attention.

If step five is yes, the control logic algorithm preferably validates the location of the roof region associated with the elevated real-time roof surface temperature and generates and transmits an output control signal 70 to the target group of water discharging assemblies such that water is permitted to flow outwardly therefrom and thereby effectively lowers the elevated real-time roof surface temperature to a level below the maximum threshold roof surface temperature.

The use of the controller 26 in the present invention provides the benefit of enabling the user to preserve property and remain at a safe distance from oncoming fires rather than staying in a dangerous situation. Additionally, the combination of the memory 40 and the processor 39 within the water distributing mechanism 23 provides the benefit the enabling the user to set the maximum threshold roof surface temperature in order to prevent the system 10 from activating when fire damage is not imminent. This claimed feature allows this system 10 to be used for with structures in climates with elevated temperatures.

In use, it is also an object of the present invention to provide a method for reducing the likelihood of fire damage while preserving water consumption. As wildfires are often a result of dry temperatures, water resources may be scarce and the water that is used to extinguish fires should be employed in the most efficient manner possible.

In use, the current method may include the chronological step of first selecting a roof structure 11 attached to a building. A second step of the method may then include providing and situating a plurality of first groups of water discharging assemblies 20 at the existing roof structure 11. Thirdly, the method's steps may include providing and situating a plurality of second groups of water discharging assemblies 21 at the existing roof structure 11. The next step of the method preferably includes providing and adapting a primary water shutoff valve 24 to receive and selectively transmit an external water supply to the first 20 and second 21 groups of water discharging assemblies respectively.

The fifth step of the method may further include providing and fluidly communicating a primary conduit 25 with the primary water shutoff valve 24 such that the primary conduit 25 travels downstream therefrom, the primary conduit 25 further being in fluid communication with the first 20 and second 21 groups of water discharging assemblies and located downstream thereof respectively. The sixth step of the method preferably includes providing and communicatively coupling a controller 26 to the primary water shutoff valve 24 to automatically operate the system without the user's constant attention.

The seventh step of the method may include automatically distributing water to a target group of water discharging assemblies selected from each of the first 20 and second 21 groups of water discharging assemblies when a roof surface temperature of a target region of the roof structure is elevated above a maximum threshold roof surface temperature such that remaining ones of the water discharging assemblies remain at off positions and thereby reduce water consumption.

The final step of the method may include the controller 26 generating and transmitting a user input signal based upon a user input to remotely interrupt the external water supply prior to reaching the first 20 and second 21 groups of water discharging assemblies.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An outdoor fire prevention system for reducing the likelihood of fire damage while preserving water consumption, said outdoor fire prevention system comprising:

a roof structure attached to a building;

a plurality of first groups of water discharging assemblies situated at the existing roof structure;

a plurality of second groups of water discharging assemblies situated at the existing roof structure;

means for automatically distributing water to a target group of water discharging assemblies selected from each of said first and second groups of water discharging assemblies when a roof surface temperature of a target region of said roof structure is elevated above a maximum threshold roof surface temperature such that remaining ones of said water discharging assemblies remain at off positions and thereby reduce water consumption;

a primary water shutoff valve in fluid communication with said automatic water distribution means, said primary water shutoff valve being adapted to receive and selectively transmit an external water supply to said automatic water distributing means;

a primary conduit in fluid communication with said primary water shutoff valve, said primary conduit further being in fluid communication with said automatic water distributing means; and a controller communicatively coupled to said primary water shutoff valve, said controller generating and transmitting a user input signal based upon a user input to remotely interrupt the external water supply prior to reaching said first and second groups of water discharging assemblies;

wherein each of said first groups of water discharging assemblies is located subjacent to each of said second groups of water discharging assemblies and comprises:

first and second water discharging nozzles positioned at oppositely facing lateral edges of said roof structure;

a plurality of first auxiliary conduits in fluid communication with said primary conduit as well as said first and second water discharging nozzles respectively; and a plurality of valves housed within a corresponding one of said first auxiliary conduits respectively, each of said valves being located downstream from an associated one of said first and second water discharging nozzles respectively;

wherein one of said valves is a main valve situated upstream of remaining ones of said valves such that water is permitted to flow to said first and second water discharging nozzles while water is restricted from flowing to an adjacent group of said first groups of water discharging assemblies that is located downstream of said main valve.

2. The outdoor fire prevention system of claim 1, wherein each of said second groups of water discharging assemblies comprises:

first, second and third water discharging nozzles positioned adjacent to an apex of said roof structure;

a plurality of second auxiliary conduits in fluid communication with said first auxiliary conduits as well as said first, second and third water discharging nozzles respectively; and a plurality of valves housed within a corresponding one of said second auxiliary conduits respectively, each of said valves being located downstream from an associated one of said first, second and third water discharging nozzles.

3. The outdoor fire prevention system of claim 1, wherein said means for automatically distributing water comprises:

a plurality of heat-detecting sensors positioned along said roof structure, each of said heat-detecting sensors generating and transmitting an information signal bearing a real-time roof surface temperature of said roof region associated therewith as well as a location of said roof region;

a processor communicatively coupled to said heat-detecting sensors; and a memory electrically coupled to said processor and including programmable software instructions that cause water to selectively reach said target group of said first and second pluralities of water discharging assemblies, said programmable software instructions including and executing a control logic algorithm including the steps of a. requesting a user to enter said maximum threshold roof surface temperature via said controller;

b. verifying receipt of said maximum threshold roof surface temperature;

c. requesting each of said heat-detecting sensors to transmit said information signal associated therewith;

d. extrapolating said real-time roof surface temperature and said roof region location from said information signals respectively;

e. determining whether any one of said real-time roof surface temperatures is elevated above said maximum threshold roof surface temperature;

f. if yes, validating said location of said roof region associated with said elevated real-time roof surface temperature; and g. generating and transmitting an output control signal to said target group of water discharging assemblies such that water is permitted to flow outwardly therefrom and thereby lower said elevated real-time roof surface temperature to a level below said maximum threshold roof surface temperature.

4. An outdoor fire prevention system for reducing the likelihood of fire damage while preserving water consumption, said outdoor fire prevention system comprising:

a roof structure attached to a building;

a plurality of first groups of water discharging assemblies situated at the existing roof structure;

a plurality of second groups of water discharging assemblies situated at the existing roof structure;

means for automatically distributing water to a target group of water discharging assemblies selected from each of said first and second groups of water discharging assemblies when a roof surface temperature of a target region of said roof structure is elevated above a maximum threshold roof surface temperature such that remaining ones of said water discharging assemblies remain at off positions and thereby reduce water consumption;

a primary water shutoff valve in fluid communication with said automatic water distributing means, said primary water shutoff valve being adapted to receive and selectively transmit an external water supply to said automatic water distributing means;

a primary conduit in fluid communication with said primary water shutoff valve and traveling downstream therefrom, said primary conduit further being in fluid communication with said automatic water distributing means and being located downstream thereof; and a controller communicatively coupled to said primary water shutoff valve, said controller generating and transmitting a user input signal based upon a user input to remotely interrupt the external water supply prior to reaching said first and second groups of water discharging assemblies;

wherein each of said first groups of water discharging assemblies is located subjacent to each of said second groups of water discharging assemblies and comprises:

first and second water discharging nozzles positioned at oppositely facing lateral edges of said roof structure;

a plurality of first auxiliary conduits in fluid communication with said primary conduit as well as said first and second water discharging nozzles respectively; and a plurality of valves housed within a corresponding one of said first auxiliary conduits respectively, each of said valves being located downstream from an associated one of said first and second water discharging nozzles respectively;

wherein one of said valves is a main valve situated upstream of remaining ones of said valves such that water is permitted to flow to said first and second water discharging nozzles while water is restricted from flowing to an adjacent group of said first groups of water discharging assemblies that is located downstream of said main valve.

5. The outdoor fire prevention system of claim 4, wherein each of said second groups of water discharging assemblies comprises:

first, second and third water discharging nozzles positioned adjacent to an apex of said roof structure;

a plurality of second auxiliary conduits in fluid communication with said first auxiliary conduits as well as said first, second and third water discharging nozzles respectively; and a plurality of valves housed within a corresponding one of said second auxiliary conduits respectively, each of said valves being located downstream from an associated one of said first, second and third water discharging nozzles.

6. The outdoor fire prevention system of claim 4, wherein said means for automatically distributing water comprises:

a plurality of heat-detecting sensors positioned along said roof structure, each of said heat-detecting sensors generating and transmitting an information signal bearing a real-time roof surface temperature of said roof region associated therewith as well as a location of said roof region;

a processor communicatively coupled to said heat-detecting sensors; and a memory electrically coupled to said processor and including programmable software instructions that cause water to selectively reach said target group of said first and second pluralities of water discharging assemblies, said programmable software instructions including and executing a control logic algorithm including the steps of a. requesting a user to enter said maximum threshold roof surface temperature via said controller;

b. verifying receipt of said maximum threshold roof surface temperature;

c. requesting each of said heat-detecting sensors to transmit said information signal associated therewith;

d. extrapolating said real-time roof surface temperature and said roof region location from said information signals respectively;

e. determining whether any one of said real-time roof surface temperatures is elevated above said maximum threshold roof surface temperature;

f. if yes, validating said location of said roof region associated with said elevated real-time roof surface temperature; and g. generating and transmitting an output control signal to said target group of water discharging assemblies such that water is permitted to flow outwardly therefrom and thereby lower said elevated real-time roof surface temperature to a level below said maximum threshold roof surface temperature.

* * * * *